US010643505B1

(12) United States Patent
Lorenzo

(10) Patent No.: US 10,643,505 B1
(45) Date of Patent: May 5, 2020

(54) STATUS INDICATOR DEVICE

(71) Applicant: Blickman Industries LLC, New York, NY (US)

(72) Inventor: Anthony F. Lorenzo, New York, NY (US)

(73) Assignee: Blickman Industries LLC, New York, NY (US)

( * ) Notice: Subject to any disclaimer, the term of this patent is extended or adjusted under 35 U.S.C. 154(b) by 0 days.

(21) Appl. No.: 16/261,940

(22) Filed: Jan. 30, 2019

(51) Int. Cl.
*G09F 9/40* (2006.01)

(52) U.S. Cl.
CPC ..... *G09F 9/40* (2013.01)

(58) Field of Classification Search
CPC ..... G09F 9/40
USPC ..... 116/284, 303–313, 316–320; 40/492, 40/482, 484, 487, 497, 907, 501, 493, 40/530, 531, 532, 533, 534; 434/404, 434/348, 168; D10/102, 122
See application file for complete search history.

(56) References Cited

U.S. PATENT DOCUMENTS 522,793 A * 7/1894 Leach ..... G09F 7/00 116/316
2,507,794 A * 5/1950 Longnecker ..... A44B 15/005 40/111
4,129,954 A 12/1978 Hulteen
D290,397 S 6/1987 Starkey
D303,098 S * 8/1989 Nester ..... D10/102
4,885,857 A 12/1989 Leflet
5,018,526 A 5/1991 Gaston-Johansson
5,467,545 A 11/1995 Zillner
5,634,472 A 6/1997 Raghuprasad
6,146,334 A 11/2000 Laserow
6,652,286 B1 * 11/2003 Larsen ..... G09B 1/02 353/27 R
D493,537 S 7/2004 Abric et al.
7,516,746 B1 4/2009 Davis
7,621,231 B2 * 11/2009 McNeely ..... A61J 7/04 116/308
9,119,522 B1 9/2015 Barksdale
D757,947 S 5/2016 Frieze et al.
2017/0345345 A1 11/2017 Jones

OTHER PUBLICATIONS

Design U.S. Appl. No. 29/673,539, filed Dec. 14, 2018.
Design U.S. Appl. No. 29/673,541, filed Dec. 14, 2018.

* cited by examiner

*Primary Examiner* — Cassandra Davis
(74) *Attorney, Agent, or Firm* — Paradice and Li LLP

(57) ABSTRACT

A status indicator device that is mountable to an object includes a flag that rotates between positions that expose indicators to provide an indication of a status of the object. The status indicator device includes a base upon which indicators are disposed. The indicators may be, e.g., stickers, decals, etc. that provide the status of the object. A flag is rotatably mounted to the base by an axis that is perpendicular to the base, so that the flag rotates with respect to the base within a plane that is parallel to the base. The flag rotates between two different positions at which different indicators are exposed. One or more flag stops may be used to stop the rotation of the flag at the desired position. A handle on the flag may be used to rotate the flag and may be configured to lock the flag in a desired position.

16 Claims, 5 Drawing Sheets

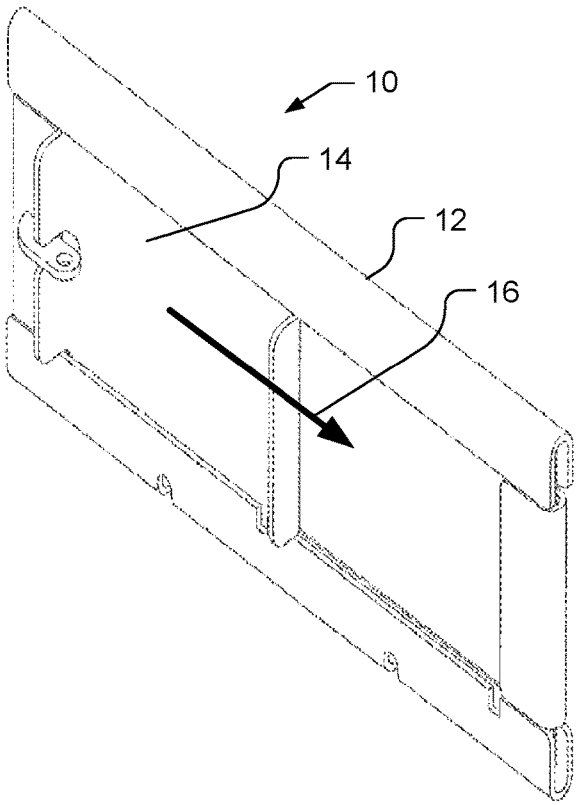
Fig. 5A
(Conventional)
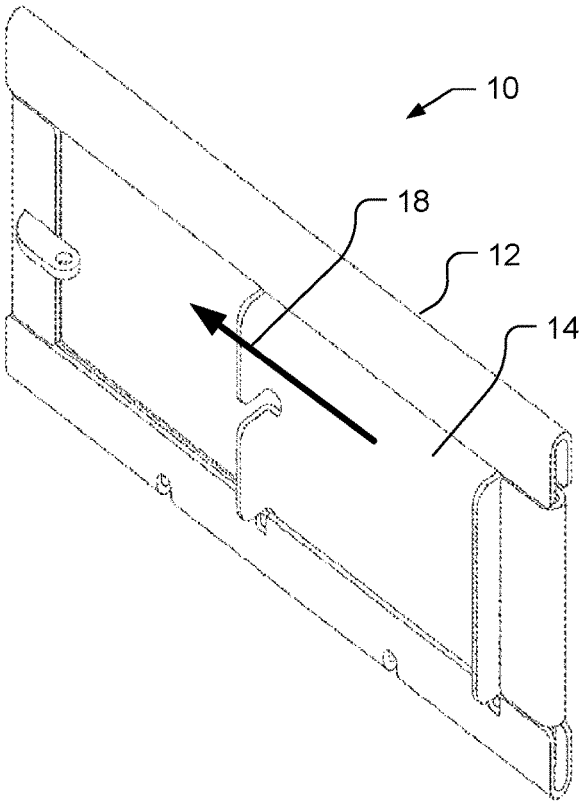
Fig. 5B
(Conventional)

STATUS INDICATOR DEVICE

FIELD OF THE INVENTION

The present invention is related to a signaling device and, in particular, to a signaling device that provides an indication of the status of an object to which the signaling device is attached.

BACKGROUND

Status indicators provide a clearly visible indication of a status of an object to which the device is attached. For example, in business offices, colored paper or plastic tags may be attached to files indicate the status of the file. As the status of a file changes, the colored tag may be manually replaced with another colored tag. Such tags, however, may be accidentally dislodged from the files to which they are attached.

In some environments, quickly and accurately determining the correct status of an object may be critical, such as in the health services. For example, in a hospital or similar environments it may be desirable to indicate whether the contents of an object are clean or dirty, sterile or unsterile, new or used, etc. In such environments, as well as in other environments, an accidental loss or change in the status of an object may have serious consequences. Accordingly, it is desirable to have a robust, multiple-use indicator that can visibly indicate the status of an object (or the contents of the object) in a clear safe manner.

SUMMARY

A status indicator device that is mountable to an object includes a rotatable flag that rotates between first and second positions, at which an exposed indicator provides an indication of a first or second status of the object. The status indicator device includes a base upon which first and second indicators are disposed. The indicators may be, e.g., stickers, decals, etc. that provide an indication of the status of the object. A flag is rotatably mounted to the base by an axis that is perpendicular to the base, so that the flag rotates with respect to the base within a plane that is parallel to the base. The flag rotates between a first position at which a first indicator is covered and a second indicator is exposed and a second position at which the second indicator is covered and the first indicator is exposed. One or more flag stops may be used to stop the rotation of the flag at the desired position. A handle on the flag may be used to rotate the flag and may be configured to lock the flag in a desired position.

In one implementation, a status indicator device includes a base having a surface with a first indicator disposed on the surface for identifying a first state and a second indicator disposed on the surface for identifying a second state, the base being configured to be mounted to an object; a pivot axis coupled to the base and disposed between the first indicator and the second indicator and positioned normal to the surface of the base; and a flag rotatably mounted to the base with the pivot axis, wherein the flag rotates with respect to the base within a plane that is parallel to the surface of the base from a first position in which the first indicator is covered by the flag and the second indicator is exposed to a second position in which the second indicator is covered by the flag and the first indicator is exposed.

In one implementation, a status indicator device includes a base having a surface with a first indicator disposed on the surface for identifying a first state and a second indicator disposed on the surface for identifying a second state, the base being configured to be mounted to an object; a rotatable flag that is parallel to the surface of the base and is rotatably mounted to the base by an axis that is perpendicular to the surface of the base, wherein the rotatable flag rotates with respect to the base between a first position at which the rotatable flag covers the first indicator and the second indicator is exposed and a second position at which the rotatable flag covers the second indicator and the first indicator is exposed; and at least one flag stop coupled to the base and positioned to stop rotation of the rotatable flag at the first position and at the second position.

In one implementation, a status indicator device includes a base having a surface with a first indicator disposed on the surface for identifying a first state and a second indicator disposed on the surface for identifying a second state, the base being configured to be mounted to an object; a rotatable flag that is parallel to the surface of the base and is rotatably mounted to the base by an axis that is perpendicular to the surface of the base, wherein the rotatable flag rotates with respect to the base within a plane that is parallel to the surface of the base between a first position at which the rotatable flag covers the first indicator and the second indicator is exposed and a second position at which the rotatable flag covers the second indicator and the first indicator is exposed, wherein the first indicator provides an indication of a first status of the object and the second indicator provides an indication of a second status of the object; at least one flag stop coupled to the base and positioned to stop rotation of the rotatable flag at the first position and at the second position; and a handle coupled to the rotatable flag, the handle comprising a tab that extends from the rotatable flag at a non-zero angle with respect to a surface of the rotatable flag.

BRIEF DESCRIPTION OF THE DRAWINGS

FIGS. 5A and 5B illustrate perspective views of a conventional disposition indicator showing different dispositions.

Like reference numbers and symbols in the various figures indicate like elements, in accordance with certain example implementations.

DETAILED DESCRIPTION

Figure 1A:
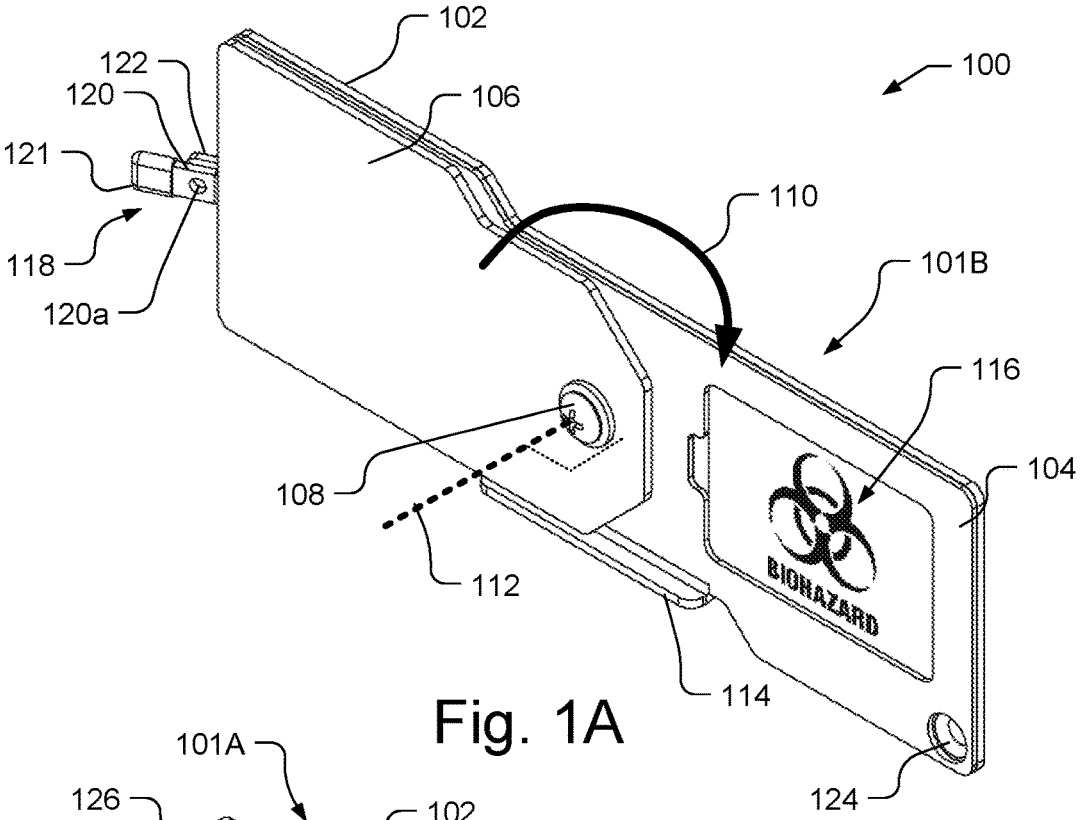
FIGS. 1A and 1B illustrate perspective views of a status indicator device indicating a first status and a second status, respectively.
Figure 1B:
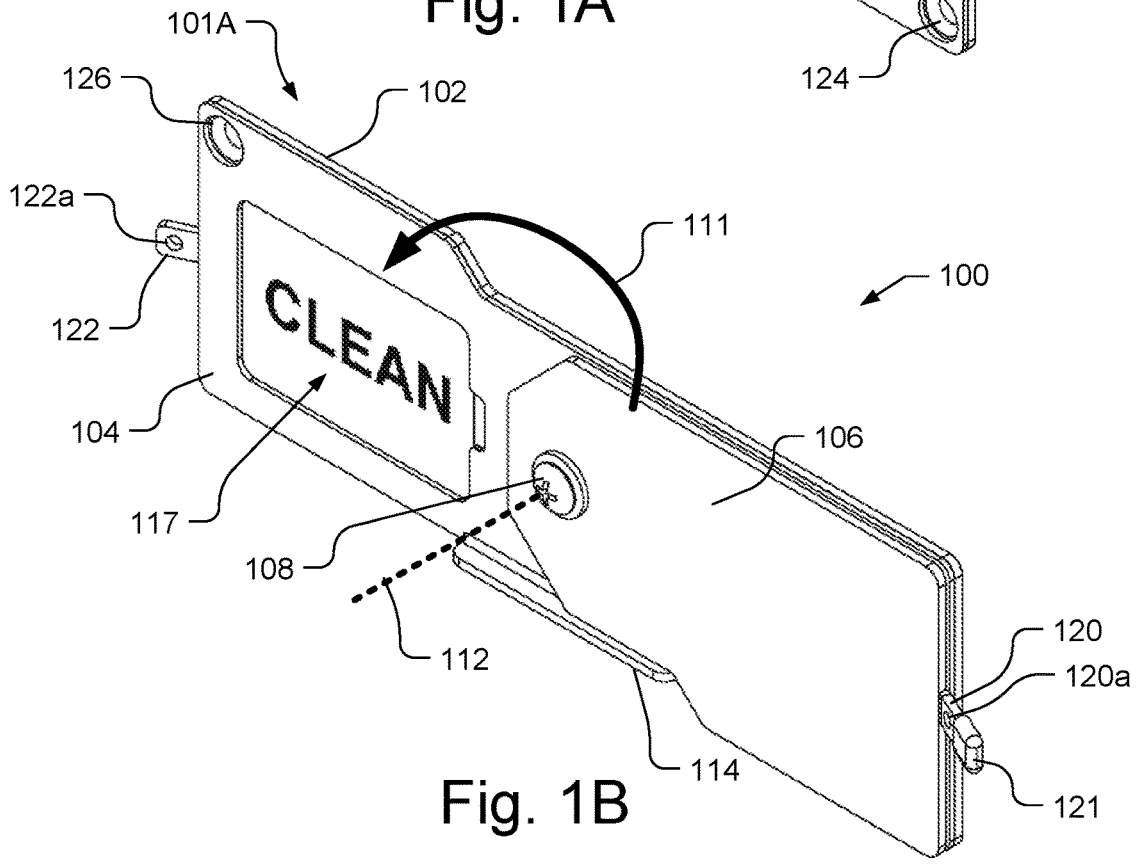
Figure 2A:
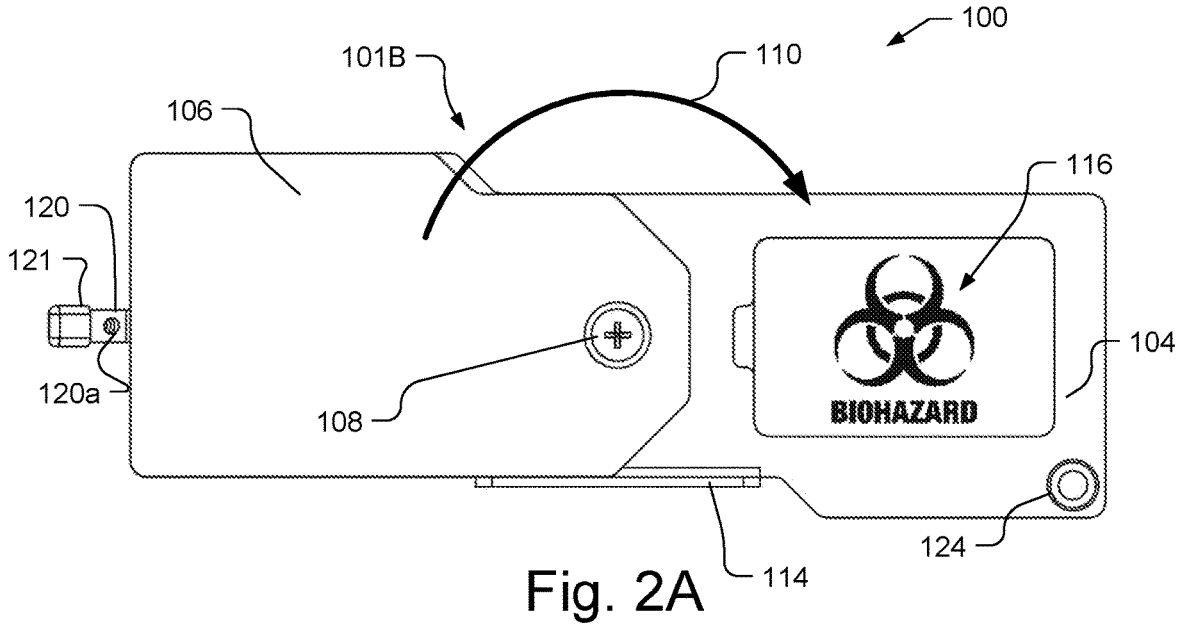
FIGS. 2A and 2B illustrate front plan views of the status indicator device indicating the first status and the second status, respectively.
Figure 2B:
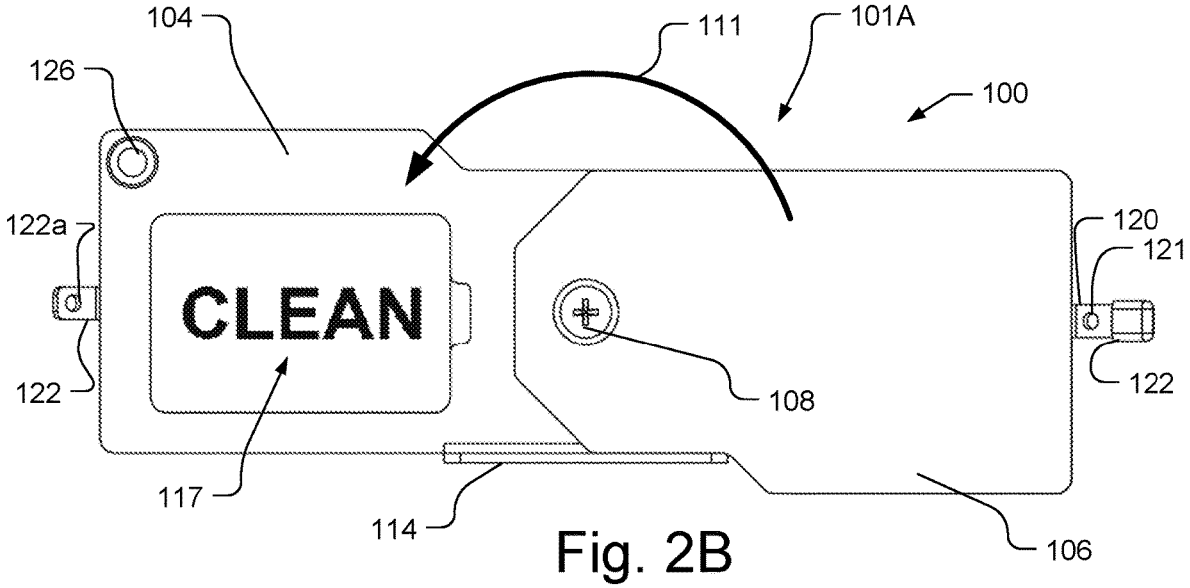
Figure 3:
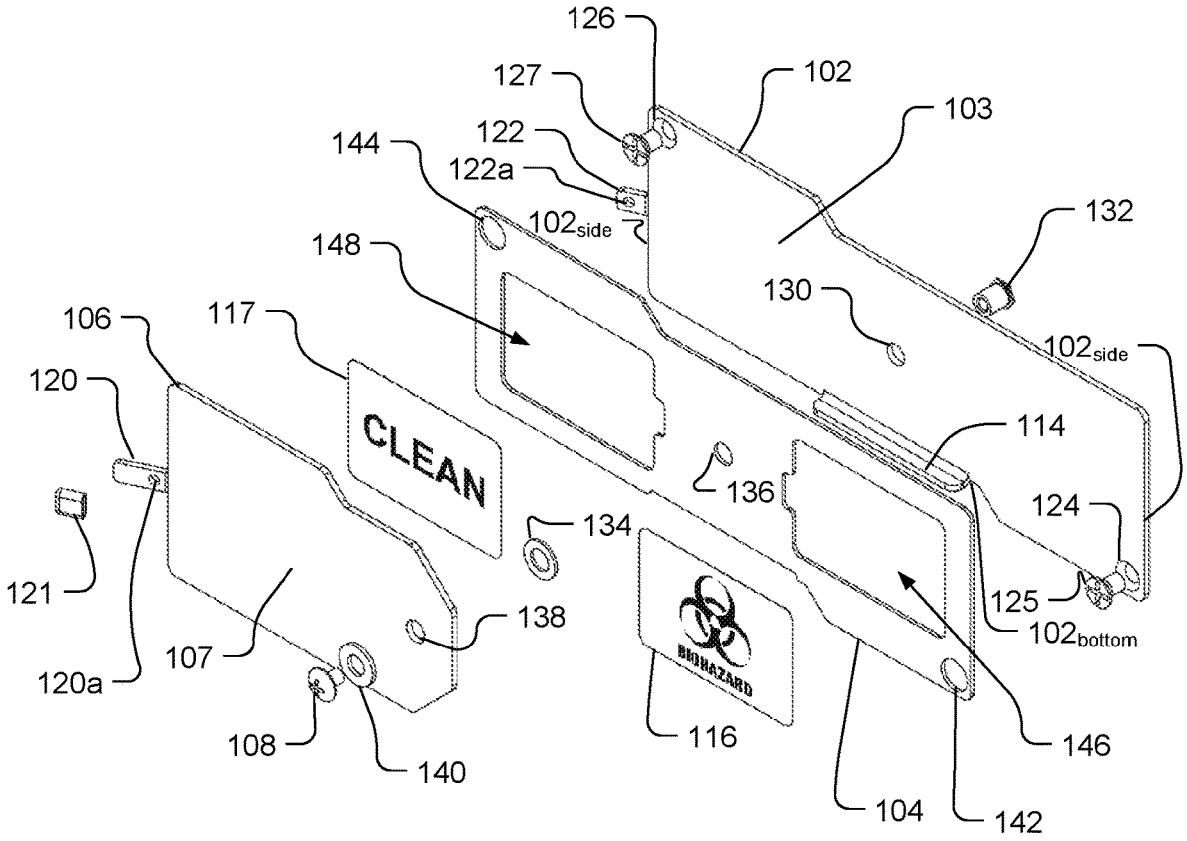
FIG. 3 illustrates an exploded perspective view the status indicator device.

FIGS. 1A and 1B illustrate perspective views and FIGS. 2A and 2B illustrate front plan views of a status indicator device 100, which is configured to be mounted to an object and to provide a visible representation of the status of the object. FIGS. 1A and 2A illustrate the status indicator device 100 providing an indication of a first status, illustrated as "BIOHAZARD," and FIGS. 1B and 2B illustrate the status indicator device 100 providing an indication of a second status, illustrated as "CLEAN". FIG. 3 illustrates an exploded perspective view the status indicator device 100.

The status indicator device 100 includes a base 102 that, as shown in FIG. 3, includes a surface 103 upon which a first indicator 116 for identifying a first status and a second indicator 117 identifying a second status are disposed. The first indicator 116 and second indicator 117, by way of example, may be stickers, decals, labels, or other similar elements. If desired, the first indicator 116 and second indicator 117 may be stamped, painted, printed, screen printed, etched, or otherwise produced directly on the base 102. Of course, the indicators 116 and 117 should be produced in a manner that is appropriate for the environment to which they will be subjected. For example, if the status indicator device 100 is to be mounted to object such as Closed Case Cart or used in other similar applications where sterilization of the object is performed, e.g., using environments such as high temperature, steam, ultraviolet light, etc., the indicators 116 and 117, as well as other components of the status indicator device 100 should be able to withstand these environments.

The first indicator 116 and second indicator 117 may be binary status indicators, e.g., the first indicator 116 and second indicator 117 may indicate opposite statuses, such as clean or dirty, sterile or unsterile, new or used. As illustrated, first indicator 116 provides an indication that the status is a biological hazard through the use of the biohazard symbol and the word "BIOHAZARD," while the second indicator 117 provides an indication that the status is clean using the word "CLEAN." It should be understood, however, that the statuses provided by the first indicator 116 and the second indicator 117 are not limited to the specific examples illustrated in the figures, but that any two statuses may be provided by the first indicator 116 and the second indicator 117. Moreover, it should be understood that the method of communication of the first indicator 116 and the second indicator 117 is not limited to the specific examples illustrated in the figures, e.g., as words and/or symbols, but any form of communication may be additionally or alternatively used, such as letters, numbers, images, or color codes.

The base 102 is configured to be mounted to an object. By way of example, the base 102 may include holes 124 and 126 through which a mechanical fastening mechanism, such as a screw, bolt, rivet, etc., may be used to attach the base 102 to an object (not shown). FIG. 3, by way of example, illustrates the use of screws 125 and 127 that may pass through the holes 124 and 126 to attach the base 102 with an object. The holes 124 and 126 may be countersunk or counterbored to allow the head of screws, bolts, rivets, etc., to sit flush or below the surface 103 of the base 102 when the base 102 is mounted to an object. While two holes 124 and 126 are illustrated, a greater (or smaller) number of holes for additional (fewer) mechanical fastening mechanisms may be used. If desired, the base 102 may be configured to be mounted to an object using other types of fastening mechanisms, such as welding or brazing. For example, the base 102 may be manufactured from a material that is appropriate for welding or brazing, and in some embodiments may include joints or contact points that are appropriate for welding or brazing. The base 102 may be configured to be mounted to an object using an adhesive fastening mechanism, such as glue or epoxy. For example, the base 102 back surface of the base 102 may be configured with one or more regions to which adhesive or epoxy may be applied. The base 102 may be directly or indirectly mounted to the object, e.g., there may be an underlying element between the base 102 and the object, e.g., the base 102 may be mounted to the underlying element and the intervening element may be mounted to the object. By way of example, one or more hook or clips may be mounted to the object, and the base 102 may be attached to the hook or clips.

The status indicator device 100 includes a flag 106 that is rotatably mounted to the base with a pivot axis 112, generally illustrated by dotted lines in FIGS. 1A and 1B. The pivot axis 112, by way of example, may be formed from a fastener that holds the flag 106 to the base 102. For example, a fastener element 132, shown in FIG. 3, such as a bushing, threaded bushing, rivet nut, etc., along with a screw 108, such as a truss head screw, or a bolt, rivet, or other similar element, may be used to rotabably hold the flag 106 to the base 102. The fastener element 132, for example, may be a PEM® stud threaded standoff, while the screw 108 may be a truss head screw. The pivot axis 112, for example, may be fixedly mounted to the base 102 (or the shield 104, if used, as discussed below) and the rotatably mounted to the flag 106, e.g., the flag 106 rotates with respect to the base 102 and pivot axis 112. Alternatively, the pivot axis 112 may be fixedly mounted to the flag 106 and rotatably mounted to the base 102 (or the shield 104, if used as discussed below), e.g., the flag 106 and pivot axis 112 rotate with respect to the base 102. Alternatively, the pivot axis 112 may be rotatably mounted to both the flag 106 and the base 102 (or the shield 104, if used as discussed below). As illustrated in FIG. 3, the pivot axis 112, e.g., the fastener element 132, may pass through an aperture 130 in the base 102 and an aperture 138 in the flag 106, and may pass through an aperture 136 in a shield, discussed below, if included. The flag 106 may rotate around the fastener element 132, and thus, the fastener element 132 may be considered the pivot axis 112 in this implementation. The aperture 130 in the base 102 may be countersunk or counterbored in the back side of the base 102 (not shown) so that the head of the fastener element 132 is flush or below the surface of the base 102 as part of the configuration of the base 102 to be mounted to an object, e.g., so that the head of the fastener element 132 does not prevent the base 102 from mounting flush to the object. Additional components, such as washers 134 and 140 may be present to assist in holding the pivot axis 112 in place and to allow smooth rotation of the flag 106. It will be understood by those skilled in the art in light of the present disclosure and the examples of hardware provided, there are that other ways in which the flag 106 may be rotatable connected to the base 102 and that the pivot axis 112 is not limited to the specific hardware or mounting techniques described.

As illustrated, the pivot axis 112 is disposed between the first indicator 116 and the second indicator 117 and is connected to the flag 106 at one end, so that the flag 106 may rotate to cover the first indicator 116 or the second indicator 117. Moreover, as illustrated in FIG. 1A, the pivot axis 112 is normal to the surface 103 of the base 102. The flag 106 rotates about the pivot axis 112 as illustrated by arrow 110 in FIGS. 1A and 2A and as illustrated by arrow 111 in FIGS. 1B and 2B. The pivot axis 112 is between the first indicator 116 and the second indicator 117 and, thus, the flag 106 rotates between a first status position 101A in which the first indicator 116 is covered by the flag 106 and the second indicator 117 is exposed (illustrated in FIGS. 1B and 2B) and a second status position 101B in which the second indicator 117 is covered by the flag 106 and the first indicator 116 is exposed (illustrated in FIGS. 1A and 2A). Thus, with the flag 106 in the first status position 101A, e.g., covering the first indicator 116 with the second indicator 117 exposed as illustrated in FIGS. 1B and 2B, the status indicator device 100 provides a clear visible indication of a first status of the object, e.g., as signified by the second indicator 117. With the flag 106 in the second status position 101B, e.g., covering the second indicator 117 with the first indicator 116 exposed, the status indicator device 100 provides a clear visible indication of a second status of the object, as signified by the first indicator 116.

With the pivot axis 112 normal to the base, the flag 106 rotates around the pivot axis 112 within a plane that is parallel to the surface 103 of the base 102. In other words, a surface 107 of the flag 106 (shown in FIG. 3) remains parallel to the surface 103 of the base 102 while the flag 106 rotates about the pivot axis 112. The rotation of the flag 106 about the pivot axis 112 in a plane that is parallel to the base 102 is particularly useful because it reduces the chance that the position of the flag 106 will be inadvertently changed, e.g., from the first status position 101A to the second status position 101B or vice versa. For example, while other types of motion of the flag may be used, such as sliding from one status position to another, or rotating about an axis that is parallel to the plane of the base 102 (e.g., as if turning a page of a book), a flag that moves with these other types of motion is more likely to be inadvertently moved to an incorrect position through incidental contact by a user.

For the sake of comparison, FIGS. 5A and 5B illustrate perspective views of a conventional disposition indicator 10, as disclosed in U.S. Pat. No. D757,947 S. The disposition indicator 10 includes a base 12 and sliding flag 14, which may be moved from first position to a second position by sliding the flag 14 to the right, as illustrated by arrow 16 in FIG. 5A or from the second position to the first position by sliding the flag 14 to the left, as illustrated by arrow 18 in FIG. 5B. The sliding flag 14, however, may be inadvertently moved from an intended position through incidental contact, e.g., by simply brushing up against the disposition indicator 10. The accidental movement of the sliding flag 14 may place the sliding flag 14 in an incorrect position, i.e., thereby indicating an incorrect status, or may place the sliding flag 14 in between the first and second position requiring the user to confirm the status of the object through inspection of the object itself, which undermines the purpose of the disposition indicator 10.

The flag 106 of the status indicator device 100 shown in FIGS. 1A, 1B, 2A, and 2B, on the other hand, requires rotational movement about the pivot axis 112, which is perpendicular to the base 102, in order to change from one status position to another. Accordingly, incidental contact, such as simply brushing against status indicator device 100, is unlikely to move the flag 106 from one status position to another. Moreover, when mounted on a side of an object, the flag 106 is gravitationally biased downward holding the flag in the first status position 101A or second status position 101B. Accordingly, the flag 106 is unlikely to be inadvertently moved from an intended status position. Further, even if there is incidental contact with the flag 106, the flag 106 will fall back to its intended status position due to gravity.

The status indicator device 100 may include additional components, such as a shield 104 that may be disposed between the flag 106 and the base 102. The shield 104 may be the same general shape as the base 102 and may include apertures 142 and 144, as illustrated in FIG. 3, that are aligned with holes 124 and 126, if used to mount the base 102 to an object. The shield 104 includes windows 146 and 148, as illustrated in FIG. 3, that frame the first indicator 116 and second indicator 117, respectively. The first indicator 116 and second indicator 117 disposed on the base 102, thus, may be observed through windows 146 and 148 of the shield 104, while the presence of the shield 104 between the rotatable flag 106 and the base 102 prevents the flag 106 from contacting and marring the first indicator 116 or second indicator 117 when the flag 106 is rotated. If desired, the shield 104 may be used to couple the pivot axis 112 to the base 102. For example, the pivot axis 112 may be mounted only to the shield 104 and the shield 104 may be mounted to the base 102 in order to couple the pivot axis 112 to the base 102.

The status indicator device 100 may include at least one flag stop 114 that is positioned to stop the rotation of the flag 106 at the first status position 101A and at the second status position 101B. As illustrated, the flag stop 114 may be positioned at a bottom edge $\mathbf{102}_{bottom}$ of the base 102 and may extend upward from the surface 103 of the base 102, e.g., approximately perpendicular to the surface 103. The flag stop 114 contacts an edge of the flag 106 during rotation to prevent the flag 106 from over rotating, thereby stopping the flag 106 at the desired status position. The flag stop 114 is illustrated in FIGS. 1A, 1B, 2A, 2B, and 3 as an elongated ledge that extends along a portion of the bottom edge $\mathbf{102}_{bottom}$ of the base 102, but other embodiments may be used. For example, two flag stops may be used to stop the rotation of the flag 106 in each of the first status position and the second status position. Moreover, if multiple flag stops are used, each flag stop may be located on a side edge $\mathbf{102}_{side}$ of the base 102 and may contact a tab on the flag 106 to stop the rotation of the flag 106 in each of the first status position 101A and the second status position 101B. Further, if desired, the flag stop 114 may be attached to or integrally formed on the shield 104, as opposed to the base 102.

Additionally, the status indicator device 100 may include a locking mechanism 118 that provides a means for locking the flag 106 in a desired status position. The locking mechanism 118, for example, may be a first locking tab 120 that extends from the flag 106 and is thus movable with the flag 106 and a stationary locking tab 122 coupled to base 102 and positioned so that that the first locking tab 120 is aligned with the stationary locking tab 122 when the flag 106 is in the desired status position. The stationary locking tab 122 may be coupled to the base 102 directly or indirectly, e.g., by extending directly from the base 102 or by extending from the shield 104, which is mounted to the base 102. The first locking tab 120 and the stationary locking tab 122 may each include holes 120*a* and 122*a*, respectively, that are aligned when the flag 106 is in the desired status position. The holes 120*a* and 122*a* are configured to accept a locking element, e.g., a clip, ring, or other element (not shown), that passes through both holes 120*a* and 122*a* to prevent rotation of the flag 106 when the flag 106 is to be locked in the desired status position.

The first locking tab 120 may be configured to serve as a handle for a user to rotate the flag 106. For example, as illustrated in FIG. 1A, the first locking tab 120 may extend from the flag 106 at a non-zero angle with respect to the surface 107 of the flag 106 and may extend farther than the stationary locking tab 122 so that a user may easily contact the first locking tab 120 without interference from the stationary locking tab 122. Moreover, the first locking tab 120 may include a cap 121 of vinyl, plastic, rubber or other similar material to provide a comfortable point of contact for a user to rotate the flag 106.

Figure 4A:
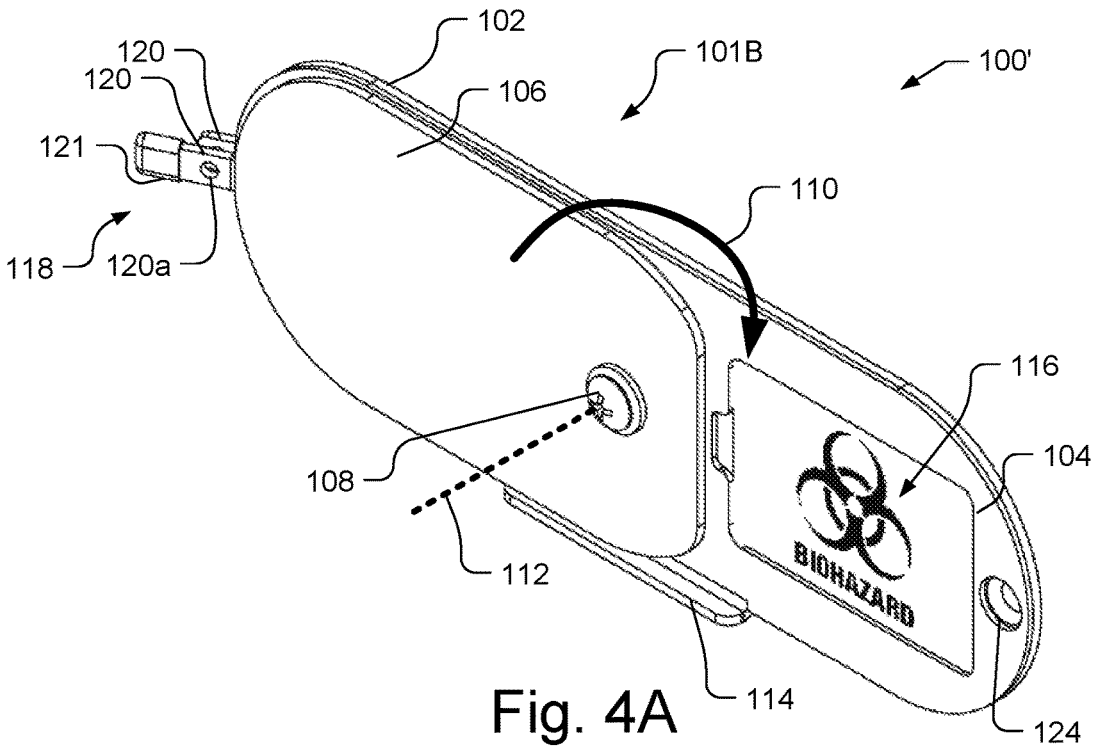
FIGS. 4A and 4B illustrate perspective views of another implementation of the status indicator device indicating the first status and the second status, respectively.
Figure 4B:
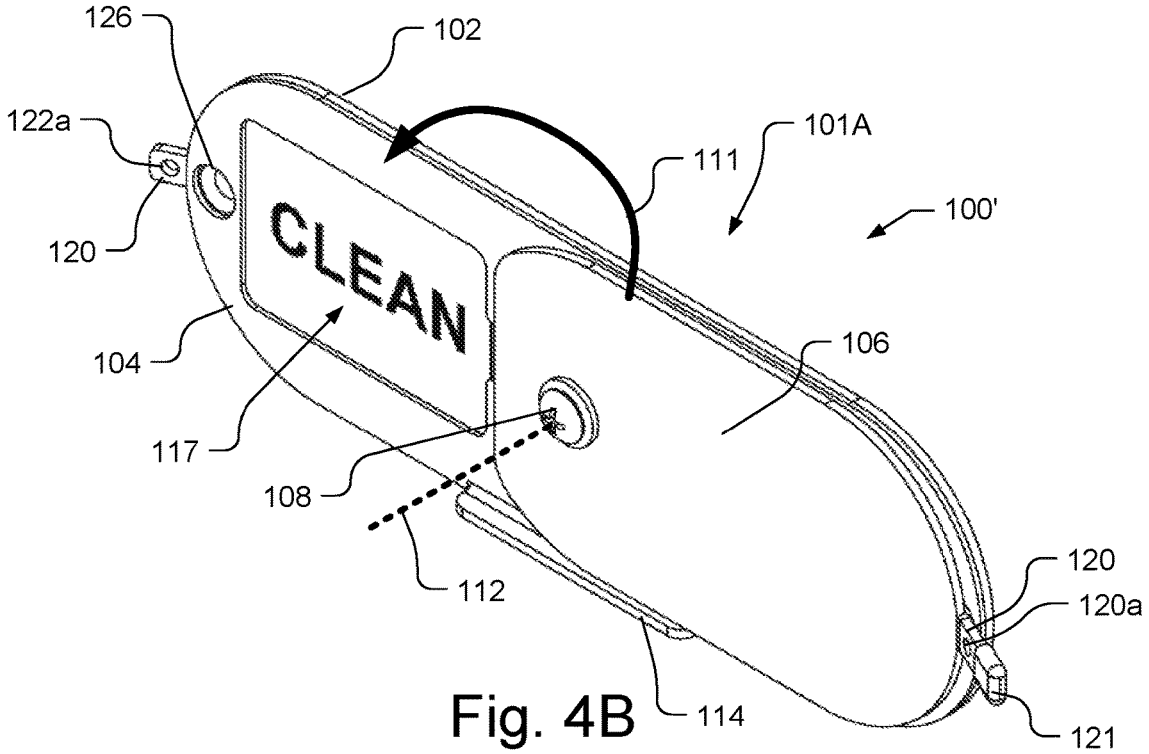

It should be understood that while FIGS. 1A, 1B, 2A, 2B, and 3 illustrate the status indicator device 100 as having a particular shape, e.g., generally rectangular with angled corners, the status indicator device 100 may be implemented with other shapes. FIGS. 4A and 4B, by way of example, illustrate perspective views of a status indicator device 100', which is similar to status indicator device 100, like designated elements being the same. As can be seen, the status indicator device 100' is similar to status indicator device 100 in operation, but has a different shape.

The terms, "and", "or", and "and/or" as used herein may include a variety of meanings that also are expected to depend at least in part upon the context in which such terms are used. Typically, "or" if used to associate a list, such as A, B or C, is intended to mean A, B, and C, here used in the inclusive sense, as well as A, B or C, here used in the exclusive sense. In addition, the term "one or more" as used herein may be used to describe any feature, structure, or characteristic in the singular or may be used to describe a plurality or some other combination of features, structures or characteristics. Though, it should be noted that this is merely an illustrative example and claimed subject matter is not limited to this example.

In the preceding detailed description, numerous specific details have been set forth to provide a thorough understanding of claimed subject matter. However, it will be understood by those skilled in the art that claimed subject matter may be practiced without these specific details. In other instances, methods and apparatuses that would be known by one of ordinary skill have not been described in detail so as not to obscure claimed subject matter.

While there has been illustrated and described what are presently considered to be example features, it will be understood by those skilled in the art that various other modifications may be made, and equivalents may be substituted, without departing from claimed subject matter. Additionally, many modifications may be made to adapt a particular situation to the teachings of claimed subject matter without departing from the central concept described herein.

Therefore, it is intended that claimed subject matter not be limited to the particular examples disclosed, but that such claimed subject matter may also include all aspects falling within the scope of appended claims, and equivalents thereof.

What is claimed is:

1. A status indicator device comprising:

a base having a surface with a first indicator disposed on the surface for identifying a first state and a second indicator disposed on the surface for identifying a second state, the base being configured to be mounted to an object;

a pivot axis coupled to the base and disposed between the first indicator and the second indicator disposed on a line connecting the first indicator and the second indicator, the pivot axis is positioned normal to the surface of the base;

a flag rotatably mounted to the base with the pivot axis, wherein the flag rotates with respect to the base within a plane that is parallel to the surface of the base, wherein the flag rotates about the pivot axis that is disposed on the line connecting the first indicator and the second indicator from a first position in which the first indicator is covered by the flag and the second indicator is exposed to a second position in which the second indicator is covered by the flag and the first indicator is exposed; and a shield disposed between the flag and the base, the shield having a first window that frames the first indicator and a second window that frames the second indicator.

2. The status indicator device of claim 1, further comprising at least one flag stop positioned to stop rotation of the flag at the first position and at the second position.

3. The status indicator device of claim 2, wherein the at least one flag stop is positioned on an edge of the base and extends upward from the surface of the base to stop the rotation of the flag.

4. The status indicator device of claim 1, wherein the base comprises one or more screw holes to mount the base to the object.

5. The status indicator device of claim 1, wherein the base comprises an adhesive to mount the base to the object.

6. The status indicator device of claim 1, wherein the first indicator provides an indication of a first status of the object and the second indicator provides an indication of a second status of the object.

7. A status indicator device comprising:

a base having a surface with a first indicator disposed on the surface for identifying a first state and a second indicator disposed on the surface for identifying a second state, the base being configured to be mounted to an object;

a pivot axis coupled to the base and disposed between the first indicator and the second indicator and positioned normal to the surface of the base;

a flag rotatably mounted to the base with the pivot axis, wherein the flag rotates with respect to the base within a plane that is parallel to the surface of the base from a first position in which the first indicator is covered by the flag and the second indicator is exposed to a second position in which the second indicator is covered by the flag and the first indicator is exposed;

a first locking tab that extends from the flag and a stationary locking tab coupled to the base, wherein the first locking tab on the flag is aligned with the stationary locking tab when the flag is in the first position; and a first hole in the first locking tab and a second hole in the stationary locking tab, wherein the first hole and the second hole are aligned when the flag is in the first position and are configured to accept a locking element to prevent rotation of the flag.

8. A status indicator device comprising:

a base having a surface with a first indicator disposed on the surface for identifying a first state and a second indicator disposed on the surface for identifying a second state, the base being configured to be mounted to an object;

a rotatable flag that is parallel to the surface of the base and is rotatably mounted to the base by an axis that is perpendicular to the surface of the base, wherein the rotatable flag rotates with respect to the base between a first position at which the rotatable flag covers the first indicator and the second indicator is exposed and a second position at which the rotatable flag covers the second indicator and the first indicator is exposed; and at least one flag stop coupled to the base and positioned to permit rotation of the rotatable flag while stopping rotation of the rotatable flag at the first position and at the second position, wherein the at least one flag stop comprises a first flag stop positioned to stop the rotation of the rotatable flag at the first position and a second flag stop positioned to stop the rotation of the rotatable flag at the second position.

9. The status indicator device of claim 8, wherein the at least one flag stop is positioned on an edge of the base and extends upward to stop the rotation of the rotatable flag.

10. The status indicator device of claim 8, further comprising a shield disposed between the rotatable flag and the base, the shield having a first window that frames the first indicator and a second window that frames the second indicator.

11. The status indicator device of claim 10, wherein the at least one flag stop extends from one of the base and the shield.

12. The status indicator device of claim 8, further comprising a handle coupled to the rotatable flag, the handle comprising a tab that extends from the rotatable flag at a non-zero angle with respect to a surface of the rotatable flag.

13. The status indicator device of claim 12, further comprising a stationary locking tab coupled to the base, wherein the tab is aligned with the stationary locking tab when the rotatable flag is in the first position and further comprising a first hole in the tab and a second hole in the stationary locking tab, wherein the first hole and the second hole are aligned when the rotatable flag is in the first position and are configured to accept a locking element to prevent the rotation of the rotatable flag.

14. A status indicator device, comprising:

a base having a surface with a first indicator disposed on the surface for identifying a first state and a second indicator disposed on the surface for identifying a second state, the base being configured to be mounted to an object;

a rotatable flag that is parallel to the surface of the base and is rotatably mounted to the base by an axis that is perpendicular to the surface of the base, wherein the rotatable flag rotates with respect to the base between a first position at which the rotatable flag covers the first indicator and the second indicator is exposed and a second position at which the rotatable flag covers the second indicator and the first indicator is exposed; and wherein the at least one flag stop comprises a single elongated ledge extending along a bottom edge of the indicator device that stops the rotation of the rotatable flag at both the first position and the second position.

15. A status indicator device comprising:

a base having a surface with a first indicator disposed on the surface for identifying a first state and a second indicator disposed on the surface for identifying a second state, the base being configured to be mounted to an object;

a rotatable flag that is parallel to the surface of the base and is rotatably mounted to the base by an axis that is perpendicular to the surface of the base, wherein the rotatable flag rotates with respect to the base within a plane that is parallel to the surface of the base between a first position at which the rotatable flag covers the first indicator and the second indicator is exposed and a second position at which the rotatable flag covers the second indicator and the first indicator is exposed, wherein the first indicator provides an indication of a first status of the object and the second indicator provides an indication of a second status of the object;

at least one flag stop coupled to the base and positioned to stop rotation of the rotatable flag at the first position and at the second position;

a handle coupled to the rotatable flag, the handle comprising a tab that extends from the rotatable flag at a non-zero angle with respect to a surface of the rotatable flag; and a stationary locking tab coupled to the base, wherein the tab is aligned with the stationary locking tab when the rotatable flag is in the first position and further comprising a first hole in the tab and a second hole in the stationary locking tab, wherein the first hole and the second hole are aligned when the rotatable flag is in the first position and are configured to accept a locking element to prevent rotation of the rotatable flag.

16. The status indicator device of claim 15, further comprising a shield disposed between the rotatable flag and the base, the shield having a first window that frames the first indicator and a second window that frames the second indicator.

* * * * *